United States Patent [19]

Stiber

[11] 4,160,524

[45] Jul. 10, 1979

[54] CIRCULATING FIREPLACE WITH ADJUSTABLE CONTROLS FOR SELECTIVELY HEATING ONE OR MORE ROOMS

[76] Inventor: Clifford W. Stiber, 1958 Winterville Rd., Athens, Ga. 30605

[21] Appl. No.: 838,386

[22] Filed: Sep. 30, 1977

[51] Int. Cl.[2] ..... F24B 7/04

[52] U.S. Cl. ..... 237/51; 126/121; 126/400; 237/55

[58] Field of Search ..... 126/120, 121, 400, 307; 237/51, 55; 98/46, 66

[56] References Cited

U.S. PATENT DOCUMENTS

| | | | |
|---|---|---|---|
| 1,588,587 | 6/1926 | Klaus | 126/121 |
| 2,333,146 | 11/1943 | Beyer | 126/121 |
| 2,671,440 | 3/1954 | Dupler | 126/121 |
| 3,888,231 | 6/1975 | Galluzzo et al. | 126/121 |
| 3,926,174 | 12/1975 | Bell | 126/121 |
| 4,010,728 | 3/1977 | Hempel et al. | 126/121 |
| 4,043,313 | 8/1977 | Sherman | 126/121 |
| 4,049,194 | 9/1977 | Tice et al. | 237/51 |
| 4,051,891 | 10/1977 | Harrison | 126/400 |
| 4,059,090 | 11/1977 | Shaw | 126/120 |

*Primary Examiner*—Henry C. Yuen

*Attorney, Agent, or Firm*—Martin P. Hoffman; Mitchell B. Wasson; Geoffrey L. Chase

[57] ABSTRACT

A wood burning system for selectively heating one, or several, rooms in a structure, such system including a fireplace with a firebox, a chimney based on a thermal vacuum principle of operation, a combustion dome interconnecting the firebox and chimney, an inlet passage and an outlet passage defined in the bottom wall of the firebox, and a barrier situated between the inlet and outlet passage to control communication therebetween.

When the barrier in the firebox is closed and a glass door seals off the open side of the firebox, the outlet passage in the firebox introduces heated air for distribution through several rooms, while the inlet passage receives the return flow of thermally spent air from the ductwork. The thermally spent air passes over the fire in the firebox and escapes up the flue. When the barrier in the firebox is opened, direct communication is established between the inlet and outlet passages so that the firebox is isolated from the ductwork and the fireplace provides heat only to the room in which it is situated. The fireplace and ductwork comprise a closed-loop heating system.

1 Claim, 13 Drawing Figures

CIRCULATING FIREPLACE WITH ADJUSTABLE CONTROLS FOR SELECTIVELY HEATING ONE OR MORE ROOMS

BACKGROUND OF THE INVENTION (a) Field of the Invention

This invention pertains broadly to wood burning, prefabricated fireplaces, and more particularly to such fireplaces that can selectively heat one, or more, rooms via ductwork that extends throughout the several rooms of the structure in which the fireplace is situated.

(b) Prior Art

Masonry fireplaces, while presenting an aesthetically pleasing appearance, are expensive to build because of their massive footings, large chimneys, etc. and yet, function ineffectively. In an effort to construct fireplaces that can be assembled, installed and operated at a reduced cost, diverse manufacturers have turned to metal fireplaces which can be built, in large measure, in a factory by semi-automated techniques.

The more efficient metal fireplaces operate on a circulating air basis to provide sufficient air to maintain the combustion of the fuel placed in the firebox. Most of the so-called circulating fireplaces draw air into the firebox through grilles, suction air intakes, etc. communicating with the air in the room in which the fireplace is situated. The heat produced by the burning of the fuel, however, is radiated into the room, or, if properly vented, into immediately adjoining rooms. However, because of the rapid rise of heated air, the bulk of the heat quickly rises to the upper levels of the room, leaving the room unevenly heated.

Consequently, most metal fireplaces operating on the circulating principle, have proven to be but modestly successful in heating the room in which they are situated. However, because a significant part of the heat produced by the fireplace either travels up the flue and is vented to the atmosphere or rises quickly to the top of the room, these fireplaces have lacked the capability of heating remote areas in the same structure. Furthermore, known fireplaces have been unable to completely consume the fuel fed thereinto in a smoke free manner because of an insufficient flow of fresh air into and through the firebox.

In order to enhance the volume, and rate of flow of fresh air into the firebox for enhancing combustion, diverse techniques were employed. In U.S. Pat. No. 3,888,231, granted June 10, 1975 to Daniel T. Galluzo et al, the patent suggests elevating the fireplace on a hearth platform and disposing an air intake vent within the platform to draw additional air into the firebox from the room in which the fireplace is situated.

In U.S. Pat. No. 3,926,174, granted Dec. 16, 1975 to Ralph Bell, the patent utilizes a conduit, which is connected with the outside air through a vent in the upper part of the building foundation, for directing cool air through ports into the firebox to enhance combustion. The ports which direct the cool air into the fire are situated in a U-shaped wall member that surrounds the front of the fireplace. The vent in the building foundation, however, may allow undesirable seepage of cold air into the building when the fireplace is not operating.

In U.S. Pat. No. 4,010,728, granted Mar. 8, 1977, to Rod Hempel et al, the patent discloses a fireplace comprising three metalic shells having air spaces therebetween for cooling purposes, and a thermosyphonic chimney with three concentric members coupled to the respective shells of the fireplace. A tapered air-intake and a blower fan mounted adjacent to the intake, and seated on the roof of the building, force large quantities of cool air into the chimney. The cool air follows a circuitous path around the chimney, combustion dome and firebox, gathering heat all the time, then dumping the valuable hot air out into the atmosphere.

Although the commercially available version of Hempel et al fireplace functioned satisfactorily in most aspects, certain shortcomings were noted in actual field installations. For example, the blower and tapered air-intake had to be disposed on the roof of the structure in proximity to the chimney, or in attic space adjacent to the chimney; in either instance, the installation was cumbersome and time-consuming. Additionally, the fireplace, when operating near peak temperatures, tended to develop "hot spots" at the point where the flow through the chimney reverses direction and failed to produce a sufficient quantity of hot air to heat other rooms within the same structure. The down and then up travel of the air forced into the chimney also proved, in practice, to produce less than optimum results for much of the hot air was discharged into the atmosphere.

Although Hempel et al suggests venting heated air from the fireplace into adjacent rooms, no system is proposed for effectively distributing heated air to remote rooms within the structure and the distribution of the heated air might tend to diminish the effectiveness of the fireplace. The heated air, furthermore, lacked a sufficient pressure head to pass rapidly to remote rooms because of the length and location of the circuitous flow path through the chimney.

SUMMARY OF THE INVENTION

Consequently, with the shortcomings of the prior art fireplaces clearly in mind, the instant invention contemplates a circulating fireplace joined in a closed-loop system within ductwork for distributing heat to remote rooms within the structure which houses the fireplace or into adjacent buildings. Control valves are situated along the run of the ductwork so that valuable quantities of the heated air can be diverted into a particular room remote from the fireplace, or can by-pass same.

Furthermore, by the simple expedient of adjusting a barrier situated in the fireplace to a first position, the fireplace can be isolated from the ductwork so that the fireplace will only heat the zone in which same is situated. By adjusting the barrier to a second position, the fireplace and ductwork are operatively joined into a heat distributing system for warming remote rooms and/or storage tank within the structure. A glass door seals the open entrance to the fireplace, when the fireplace and ductwork are operatively joined together.

The instant invention provides an efficient, smokeless fireplace capable of burning wood, trash, scraps, etc., and yet produces an external temperatures that is but slightly elevated above room temperature. Consequently, the fireplace can be mounted with "zero clearance" against wood or other combustible materials used in buildings, mobile homes, and other structures, and undesirable "hot spots" are minimized.

The instant invention employs a sizeable air inlet that allows large quantities of cool fresh air to be forced through the fireplace for optimum efficiency without resort to blowers, special intakes, etc.

The instant invention employs a chimney formed of coaxial shells that define spaces therebetween for the passage of cold fresh air in a tortuous, alternately up and down fashion, the length of the path exceeding the lengths achieved in previous fireplace chimneys of comparable size. The increase in the length of the flow path through the chimney increases the length of time that the heated air and the cool fresh air are in indirect heat transfer relation.

Furthermore, the chimney is capped at its upper end so that only the centrally disposed flue vents to the atmosphere, and the joints in the fireplace are tightly sealed. Thus, when a fire is started in the firebox, a thermal vacuum is created of sufficient intensity to force the heated air through a ductwork extending throughout the structure.

Yet other advantages attributable to the instant invention will become apparent from the following detailed description of the invention when construed in harmony with the accompanying drawings.

DESCRIPTION OF THE PREFERRED EMBODIMENT

Figure 1:
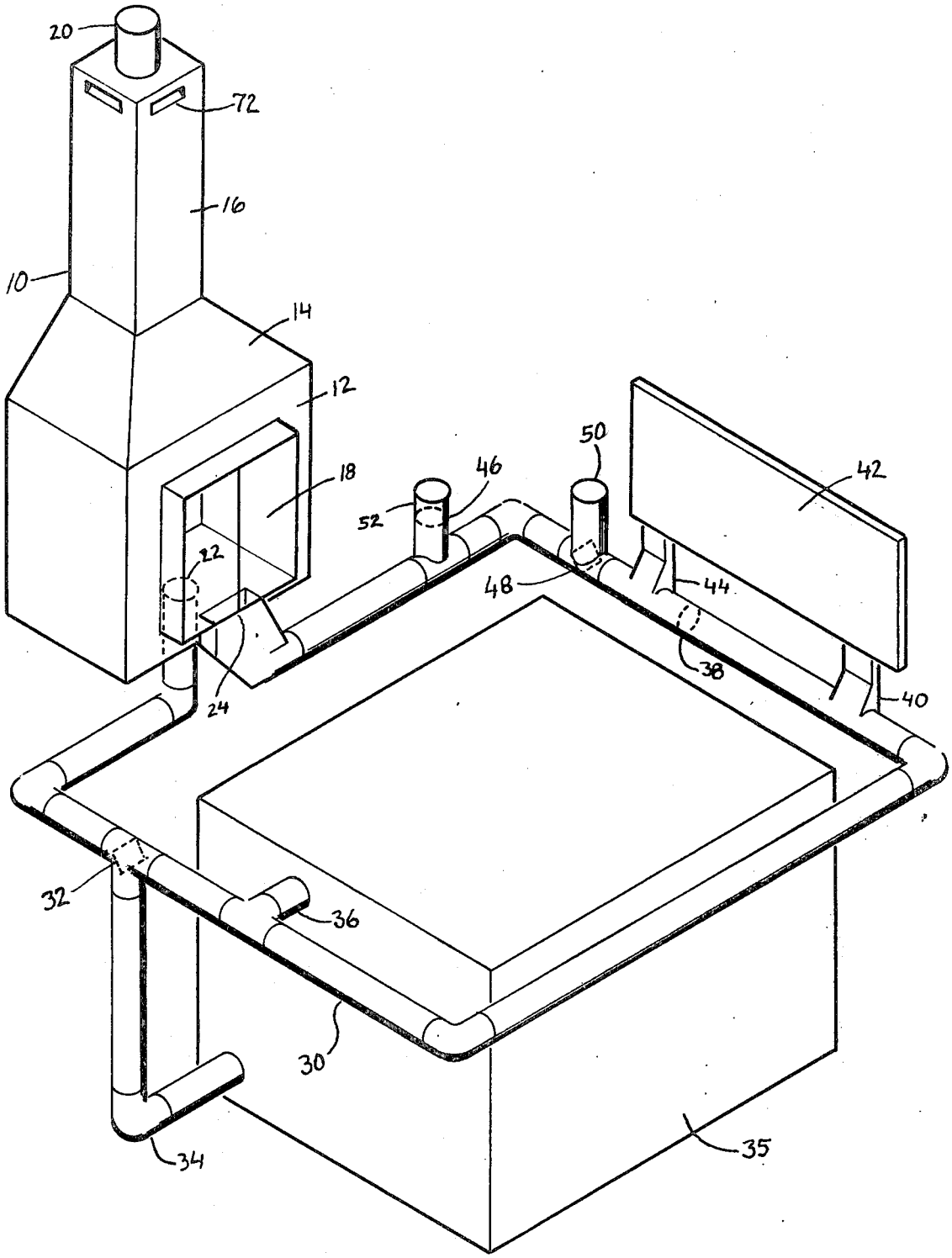
FIG. 1 is a schematic representation of a fireplace constructed in accordance with the principles of the instant invention and the ductwork for distributing the heated air produced by the fireplace.

Turning now to FIG. 1 of the drawings, the unique fireplace, and the heat distributing ductwork, are schematically shown. The fireplace is indicated generally by reference numeral 10, and comprises, principally, a firebox 12, a combustion dome 14, and a chimney 16. A glass door 18 covers the front of the firebox 12, while a flue 20 projects upwardly through the chimney. An outlet passage 22 (shown in dotted outline) is defined near the center of the bottom wall of firebox 12, while an inlet passage 24 is defined near the front of the firebox, a short distance behind door 18.

The ductwork, indicated generally by reference numeral 30, distributes the heated air produced by fireplace 10. Access to the ductwork, which is made of tubular galvanized steel or the like, is achieved via outlet passage 22 in the fireplace, and the thermally spent air is returned to the fireplace via inlet passage 24. A valve 32 is disposed in the ductwork 30 at the junction of the ductwork and vertically extending conduit 34. The valve is usually in its open position so that the heated air passes downstream through the ductwork; however, in response to manual adjustment or thermostatic signals, the valve can be pivoted into its closed position to divert the heated air through conduit 34 and into storage tank 35. The storage tank, which may assume diverse forms, i.e., rocks, fluid filled containers, etc. stores the heated air until an appropriate thermostatic control generates a signal to release the heated air from the tank via exit pipe 36 into ductwork 30 downstream of the damper 32.

The heated air travels through the ductwork 30 until reaching a second heat responsive valve, 38 situated in a room remote from the fireplace 10. The valve 38 is adjusted, either automatically or manually, to a setting that corresponds to the desired temperature in such remote room. If the room temperature is at a comfortable level, then valve 38 will be left fully open so that the heated air will pass downstream without significantly influencing the room temperature. If, however, the room temperature is at an uncomfortable level, then the valve will be pivoted closed to block the passage of the heated air. The heated air will quickly accumulate in ductwork 30 and will rise through exit duct 40 into heat exchanger 42 situated in the room to be heated. The heat exchanger 42 will extract the desired heat from the heated air and expel same into the room; the thermally spent air will be expelled from the heat exchanger through duct 44 downstream of closed valve 38.

The heated air, despite its decreased temperature, continues downstream toward inlet passage 24 in the bottom wall of the firebox 12. Additional valves 46 and 48 control the passage of the heated air into vertical conduits 50, 52 situated in additional rooms remote from the fireplace. Both valves 46, 48 are normally positioned so that the heated air usually flows past the conduits 50, 52; however, by appropriate adjustment of the valves, either one or both of the additional rooms can be heated. The temperature of heated air returning to the fireplace via passage 24 has been significantly lowered, for the heated air may have surrendered some of its thermal energy to the storage area 35, to the heat exchanger 42, to the several rooms encompassed by the ductwork, and to frictional losses in passing the heated air through the ductwork.

The ductwork may be situated adjacent the bottom molding in each room, and the heat exchanger may be situated within the wall at a higher level. Sundry other positions could be selected for these components without diminishing their efficiency.

Figure 2:
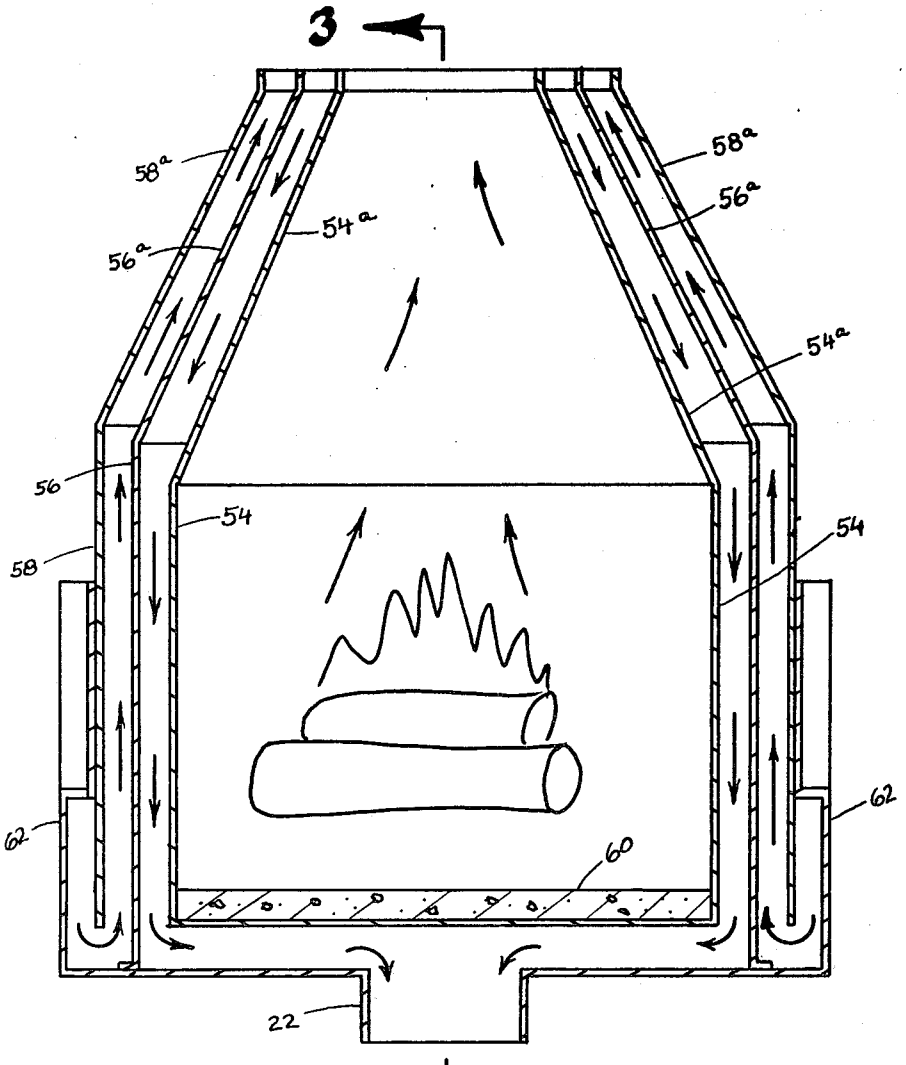
FIG. 2 is a vertical cross-sectional view of the fireplace with the chimney removed.
Figure 4:
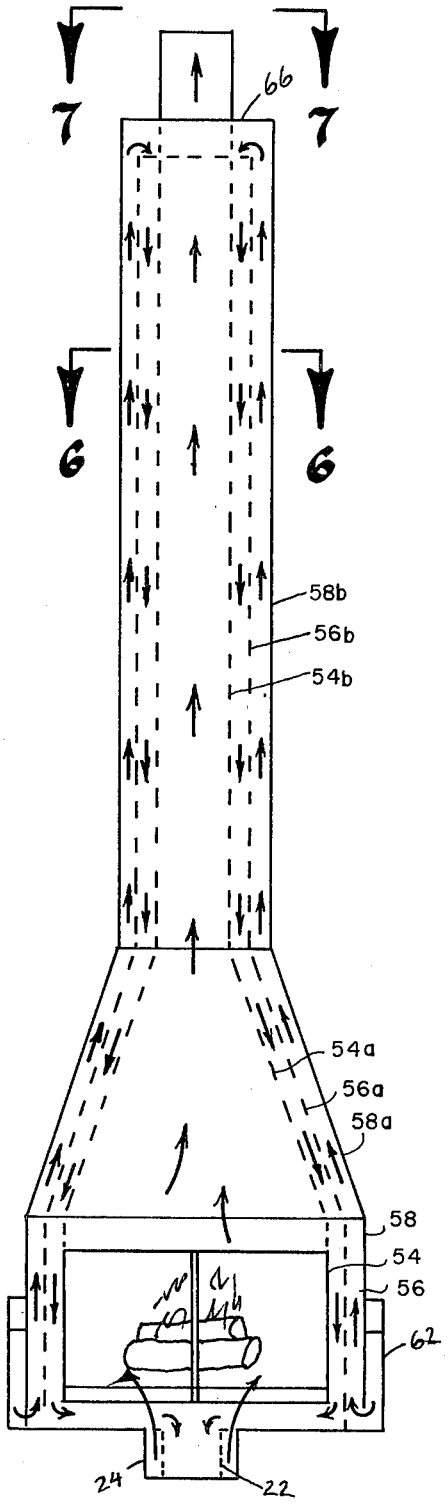
FIG. 4 is a front elevational view of the fireplace with arrows schematically depicting the flow of fresh air through the fireplace.

FIG. 2 shows the firebox 12 and combustion dome 14 of the fireplace 10; the chimney 16 has been removed for the sake of clarity. The firebox 12 consists of an inner shell 54 that is open at its front face, an intermediate shell 56, and an outer shell 58. A concrete floor 60 extends across the bottom of inner shell 54, and the fuel for the fire is placed thereon and ignited. Alternatively, a grate (not shown) may be set upon the floor 60 to receive the fuel. The three shells of the firebox and joined to the three similar shells 54*a*, 56*a* and 58*a* that comprise the combustion dome 14, and the shells of the combustion dome, in turn, are secured to the three shells 54*b*, 56*b* and 58*b*, that comprise the chimney 16. The spaced shells define substantially annular spaces therebetween for the rapid circulation of air for cooling the fireplace, minimizing "hot spots", and for producing a pressure head of sufficient magnitude to force heated air throughout ductwork 30. A glass door 18 seals the open front face of the firebox 12, which door may be made of two halves hinged on opposite sides to the firebox.

Figure 3:
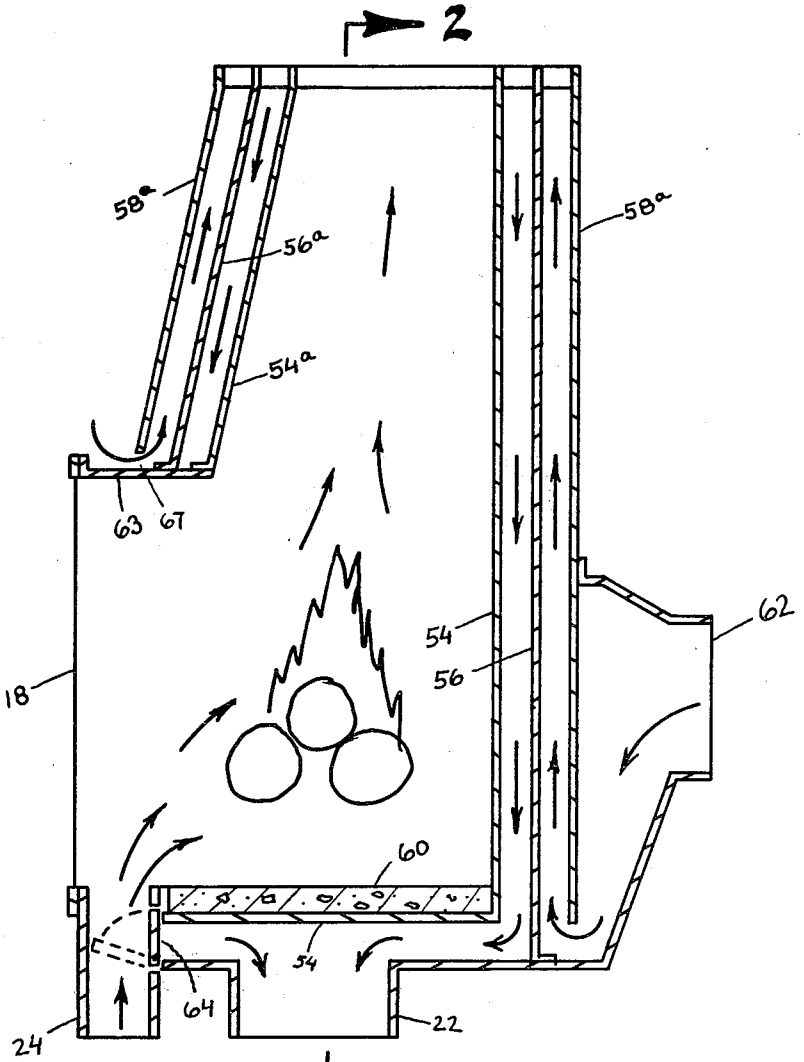
FIG. 3 is a side elevational view of the fireplace with the chimney removed, such view being taken along line 3—3 in FIG. 2.

As shown in FIGS. 2 and 3, an outer metallic casing 62 extends around the lower end of the firebox and is in communication therewith. The lower end of shell 56 rests upon, and is secured to, casing 62 and the floor 60 of the firebox 12 is spaced above the bottom wall of the casing. The shells 54 and 58 terminate above casing 62. The outlet and inlet passages 22, 24 for the firebox 12 open downwardly through the casing 62. A lip 63 extends horizontally at the front of the firebox 12, and inner shell 54*a* rests upon, and is secured to, lip 63.

Casing 62 functions as a header for introducing large quantities of fresh air into the space defined between outer shell 58, 58*a* and intermediate shell 56, 56*a*. The inlet for casing 62 projects outwardly through the wall of the room in which the fireplace is mounted to furnish the fireplace with the large quantities of cool fresh air needed for optimum operation. Alternatively, a standpipe may project vertically upwardly in the vicinity of the chimney 16 to admit sufficient quantities of fresh air into casing 62.

A barrier 64 is located beneath the floor 60 of the firebox, intermediate outlet passage 22 and inlet passage 24. When the barrier is closed, as shown in solid lines in FIG. 3, direct communication between the ducts is prevented and the heated air flows from the outlet duct, through ductwork 30, enters duct 24 and then flows upwardly through the flue 20. Thus, when the barrier 64 is closed, the fireplace and ductwork function as a heating system. Conversely, when barrier 64 is opened, as indicated by the dotted lines in FIG. 3, direct communication between the passages 22, 24 is established, the fireplace 10 is isolated from ductwork 30, and functions only as conventional fireplace.

The directional arrows in FIGS. 4, 5, 6 and 7 show the flow path of the air passing through the fireplace 10. Similar directional arrows are also seen in FIGS. 2 and 3 The damper 65 in the combustion dome 14 is swung open to the position shown in FIG. 5, a fire is lit in the firebox, and then heated air rises, creating a thermal vacuum which draws fresh air into the fireplace. Because of the unique design of the fireplace, the sealing effect of door 18, the sealing of the joints between adjacent segments of the shells, and the use of a cap to seal the upper end of the chimney, the natural draft of the fire in the firebox is sufficient to initiate and maintain the rapid movement of air through the fireplace.

Figure 5:
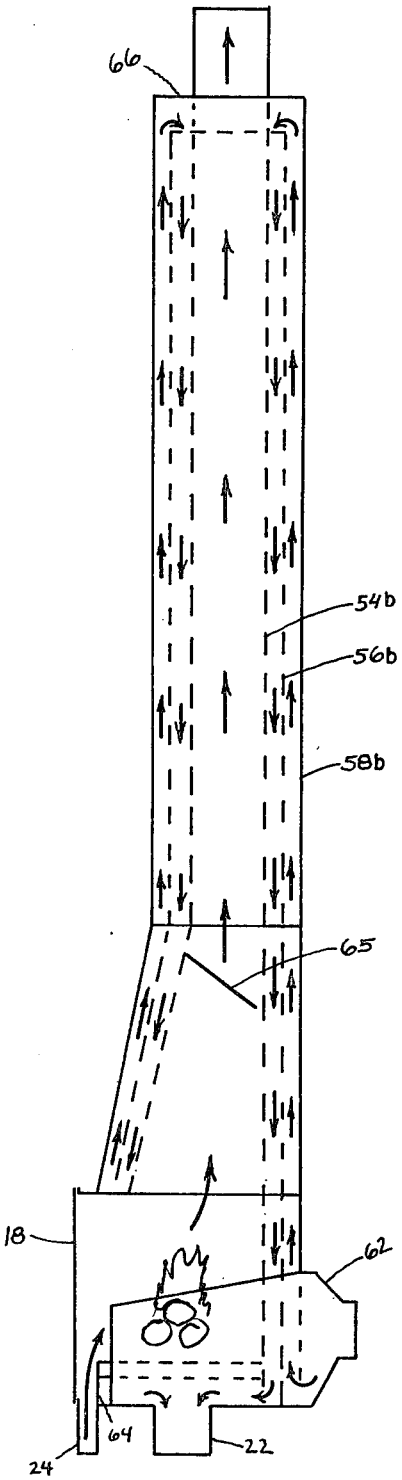
FIG. 5 is a side elevational view of the fireplace with arrows schematically depicting the flow of fresh air through the fireplace.

The large volume of fresh air entering the inlet for casing 62, flows through the aperture between the bottom of outer shell 58 and casing 62, and then travels upwardly through the combustion dome 14 and chimney 16 within the space defined between outer shell 58 and 58*a*, and intermediate shell 56, 56*a*. At the top of the chimney, the air strikes chimney cap 66, reverse direction, and flows downwardly within the space defined between intermediate shell 58, 58*a* and inner shell 54, 54*a* below the floor 60 of the firebox 12. If the damper 64 is closed, and the glass door 18 is shut, as shown in FIGS. 3 and 5, air, which has now been heated by the fire in the firebox, exits via outlet passage 22 and flows into ductwork 30. After heating one or several remote rooms, or after filling the storage tank 35, the thermally spent air returns to the inlet passage 24 in the firebox 12, passes over the fire, and exits up the flue 20. If the barrier 64 is opened to allow direct communication between passages 22 and 24, the fireplace radiates heat only into the room in which it is situated.

Additional cooling air can be admitted into the chimney through aperture 67 which is situated between lip 63 and outer shell 58*a*. The cooling air admitted at this particular location reduces the opportunity for "hot spots" to develop at this troublesome location.

Figure 7:
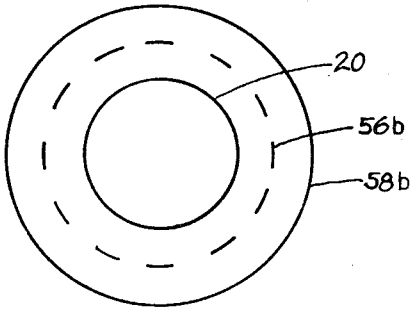
FIG. 7 is a horizontal cross-sectional view of the chimney cap and flue, such view being taken along line 7—7 in FIG. 4 and in the direction indicated.
Figure 6:
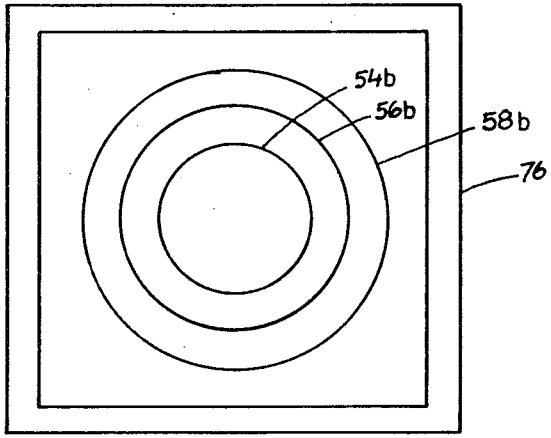
FIG. 6 is a horizontal cross-sectional view of the chimney, such view being taken along line 6—6 in FIG. 4 and in the direction indicated.

FIG. 6 is a horizontal cross-section view of the chimney 16 of the fireplace 10. The spaces between the adjacent shells 54, 56, and 58, which allow the unimpeded flow of fresh air through the fireplace, are clearly shown. Also, FIG. 7 shows the relationship of cap 66 and the flue 20 of chimney 16.

Figure 9:
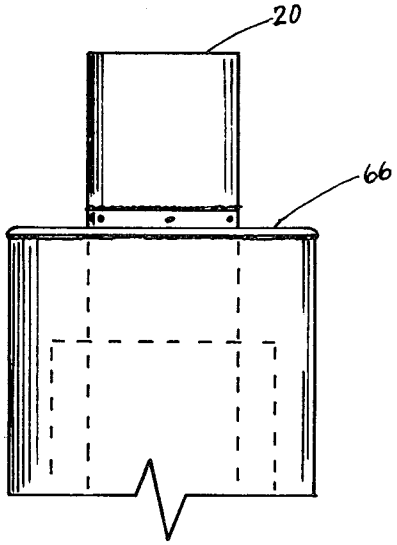
FIGS. 8 and 9 are fragmentary elevational views of the cap and upper end of the chimney for the instant fireplace.
Figure 8:
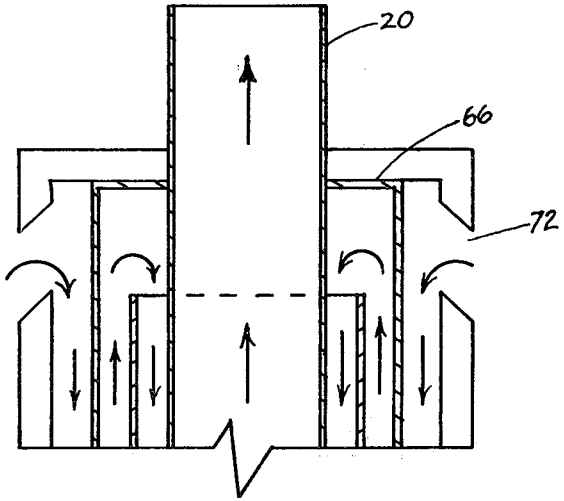
Figure 10:
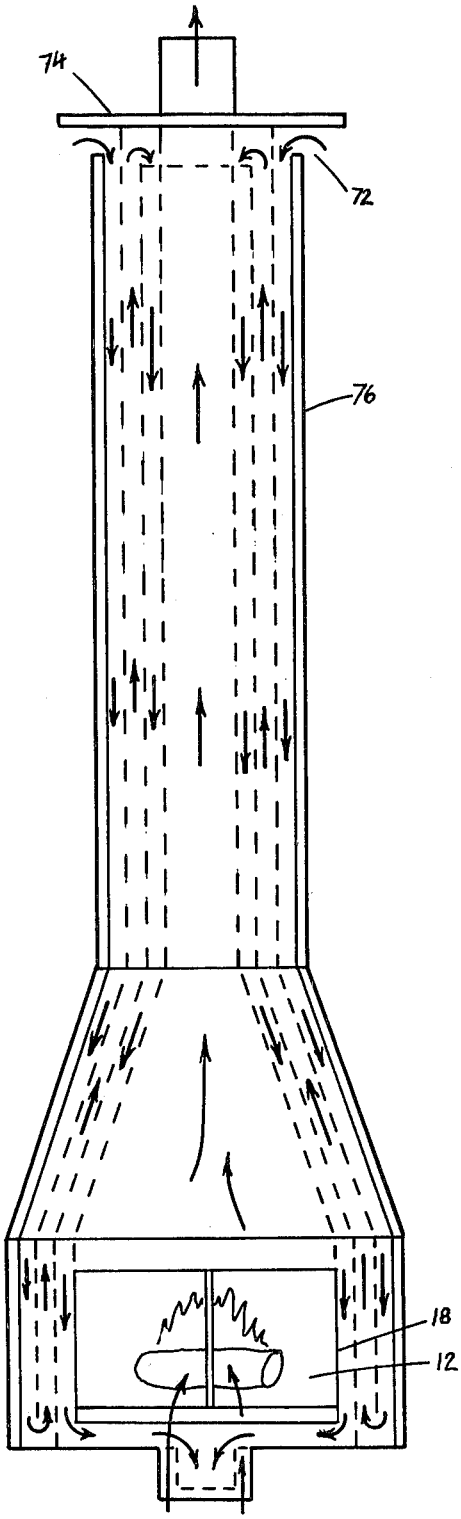
FIG. 10 is a front elevational view of an alternative embodiment of the fireplace with arrows schematically depicting the flow of fresh air through the fireplace.
Figure 11:
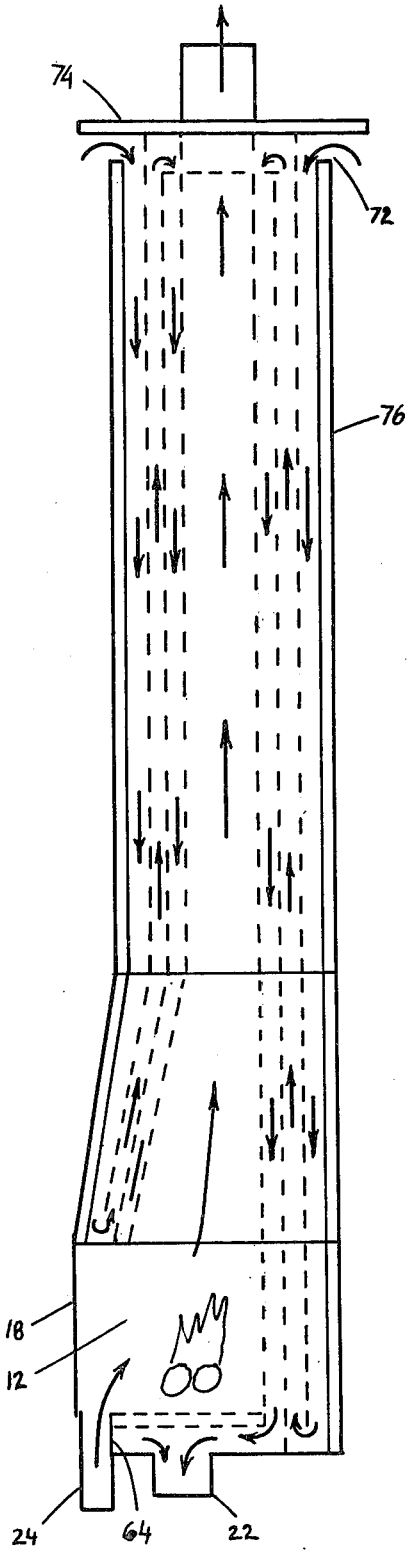
FIG. 11 is a side elevational view of the alternative embodiment of the fireplace with arrows schematically depicting the flow of fresh air through the fireplace.
Figure 13:
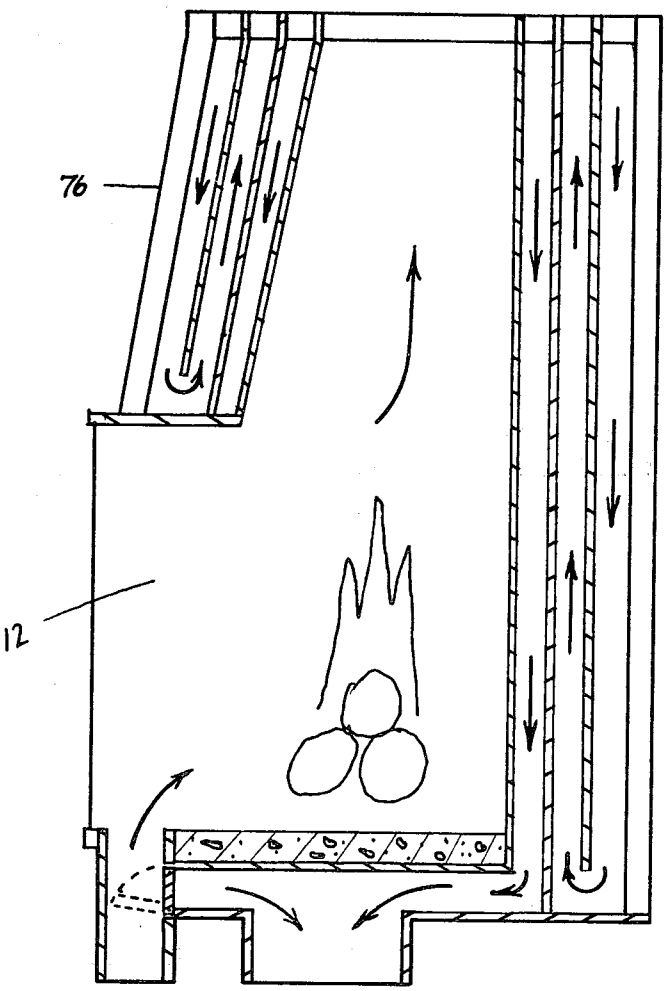
FIG. 13 is a side elevational view of the alternative embodiment of the fireplace with the chimney removed.
Figure 12:
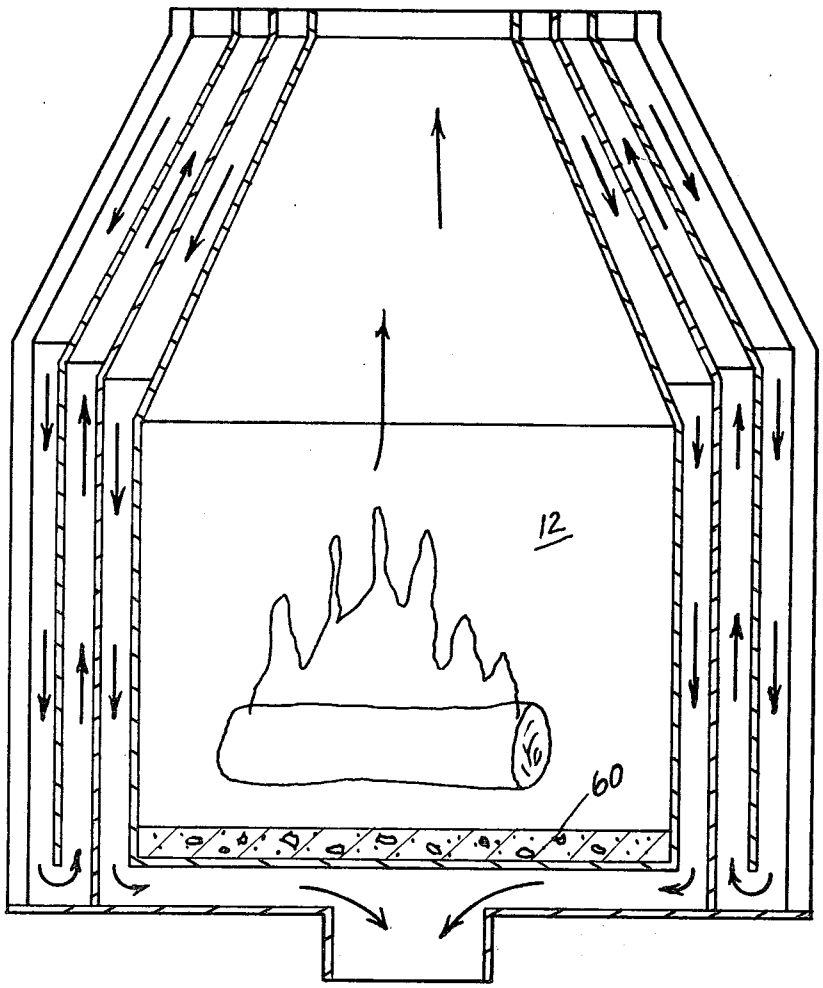
FIG. 12 is a vertical cross-sectional view of the alternative embodiment of the fireplace with the chimney removed.

FIGS. 8 and 9 shows additional details of the cap 66 and the upper end of chimney 16. The cap 66 is secured to the chimney 16 by several screws 68, and the joints formed between the two members are sealed with a cement-like material. As noted previously, all joints within the fireplace are sealed to prevent leakage of heat and diminuition of the necessary pressure head for distributing the heated air to the ductwork. Additional air-intakes 72 are formed in the upper end of the chimney 16 to admit fresh air into the chimney.

FIG. 10 thru 13 depict an alternative embodiment of the instant fireplace. Whereas the casing 62 that serves as an air inlet and header for the preferred embodiment of FIGS. 1–9 is situated at the rear of the firebox and outwardly through the wall of the room in which the fireplace was situated, the alternative embodiment of FIGS. 10–13 utilizes an air inlet 72 that is situated between cap 74 and the upper end of the outer insulating sheath 76. The sheath 76 comprises an outer layer of durable aluminum foil that surrounds an inner layer of thermal insulating material, such as fiberglass. In field tests, a sheath has been fabricated from a commercially available material sold by the Certainteed Corporation under the trademark Ultra-Duct ®.

Whereas the fireplace 10 shown in the preferred embodiment of FIGS. 1–9 is constructed with three spaced shells 54, 56, 58, wrapping or otherwise securing sheath 76 about the periphery of the fireplace produces, in effect, a fourth shell. Consequently, the tortuous flow path for the cool fresh air admitted at the inlet 72 is lengthened by adding an additional passage. The fresh air thus enters into the chimney, is drawn downward, returns upward, and is then drawn downwardly again for a third pass before flowing beneath the floor 60 of the firebox 12. If the barrier 64 is closed, communication between the outlet and inlet passages 22 and 24, respectively, will be prevented and the heated air will leave the fireplace 10, flow through the ductwork 30, and return to inlet passage situated behind the door and in front of the fire. The thermally spent air will pass over the fire and will rise up the flue.

It is noted that the longer tortuous path in both embodiments of the fireplace keeps the cool fresh air in indirect heat-exchange relation with the heated air passing up the flue for an extended period of time, thus elevating the temperature of the large quantities of cool fresh air drawn into the fireplace by the thermal vacuum effect initiated and sustained by the fire in the firebox. Also, the entrance of the fresh air at the top of the chimney in the alternative embodiment is advantageous, for there is no need to form openings in the walls of the room in which the fireplace is situated, as may be the case in utilizing the fireplace of the preferred embodiment. Additionally, the thermal sheath 76 reduced the chances for forming undesirable, localized "hot spots" on the fireplace, thus making the fireplace better suited for "zero clearance" mounting against wood studs, and other combustible materials used in permanent structures as well as in mobile homes.

Other modifications, revisions and alterations in the above described fireplaces, and in the ductwork operatively associated therewith, will occur to the skilled artisan to which the invention appertains without departing from the thrust of the instant invention. For example, a gas burner or electric heater could be substituted for the wood burning fire in the firebox without a decrease in performance, and a rain cap could be added to the upper end of the chimney. Furthermore, although the disclosed fireplaces may selectively heat one or more rooms within a structure, the structure may be a warehouse or hangar without any rooms subdividing the interior space; in such case, the fireplace may heat remote zones, rather than rooms remote from the fireplace. The fireplace and associated ductwork may heat structures adjacent to the structure housing the fireplace.

Also, the ductwork 30 may be omitted if small areas are to be heated, and the heated air can be stored in a crawl space under the floor boards in a building. The fireplace and ductwork can be utilized as a back-up system in conjunction with a solar powered heating system, and the cool fresh air may be drawn from the collectors in the solar powered heating system, rather than from the atmosphere. While the fireplace and associated ductwork have been described in conjunction with the installation of a new heating system, the fireplace and ductwork can be ducted into a pre-existing heating system. The blower of the existing heating system could be utilized to enhance the effectiveness of the thermo-vacuum that pulls the heated air through the ductwork. Consequently, the appended claims should be broadly construed in a manner commensurate with the scope of the invention and should not be construed in a literal, limiting fashion.

I claim:

1. A closed loop heating system for selectively heating one or more zones within a structure, said system comprising:

(a) a metal fireplace (10) including a firebox (12) having a floor (60), two sidewalls and a rear wall for receiving the fuel to be consumed, (b) a removable closure (18) for sealing the open face of the fireplace, (c) a chimney (16), (d) a combustion dome (14) joining the firebox to the chimney, (e) said firebox, said combustion dome, and said chimney being formed of three spaced metallic shells (54, 54*a*, 54*b*; 56, 56*a*, 56*b*; 58, 58*a*, 58*b*) with air passages defined between adjacent shells, (f) the innermost of the shells (58*b*) projecting upwardly above the other shells to function as a flue for said chimney, (g) an annular cap (66) extending across the upper ends of the two outermost shells (FIG. 6), (h) a metal casing (62) secured to the lower end of the outer shell with a portion of said casing extending forwardly below the floor of said firebox but spaced therefrom, (i) said casing being in fluid communication with the tortuous passage defined between said shells (FIG. 3), (j) air inlet means defined in said casing for freely admitting large quantities of air into the continuous tortuous passage defined between the several shells, the tortuous passage terminating in the space defined between the bottom of said firebox and the portion of said casing spaced therebelow, (k) a first passage (22) in fluid communication with the tortuous passage defined between the several shells, said passage opening downwardly through the casing, (l) a second passage (24) opening upwardly through the casing adjacent to the front of the firebox and in fluid communication therewith, (m) said first and second passages normally being in direct fluid communication, (n) ductwork (30) having at least one heat exchanger connected between said first and second passages for distributing heated air to the remote zones and returning the spent air to the front of the firebox, and (o) adjustable barrier means (64) located in said second passage below the floor of the firebox, (p) said barrier means being movable to a first position to block direct communication between the first and second passages defined in the firebox so that air heated along the tortuous path is forced into the ductwork for distribution, (q) said barrier means being movable to a second position to allow unimpeded direct communication between the first and second passages in the firebox and isolate the fireplace from the ductwork.

* * * * *